US007921820B2

(12) United States Patent
Kimura et al.

(10) Patent No.: US 7,921,820 B2
(45) Date of Patent: Apr. 12, 2011

(54) VALVE TIMING CONTROL APPARATUS

(75) Inventors: Ichiro Kimura, Nagoya (JP); Yoshiyuki Kawai, Nagoya (JP)

(73) Assignee: Aisin Seiki Kabushiki Kaisha, Kariya-Shi, Aichi-Ken (JP)

( * ) Notice: Subject to any disclaimer, the term of this patent is extended or adjusted under 35 U.S.C. 154(b) by 361 days.

(21) Appl. No.: 12/334,936

(22) Filed: Dec. 15, 2008

(65) Prior Publication Data

US 2009/0159025 A1 Jun. 25, 2009

(30) Foreign Application Priority Data

Dec. 20, 2007 (JP) ..... 2007-328858

(51) Int. Cl.
*F01L 1/34* (2006.01)

(52) U.S. Cl. ..... 123/90.17; 123/90.15

(58) Field of Classification Search ..... 123/90.15, 123/90.17

See application file for complete search history.

(56) References Cited

U.S. PATENT DOCUMENTS

| | | | | |
|---|---|---|---|---|
| 6,601,554 | B1 * | 8/2003 | Schafer et al. | 123/90.17 |
| 7,178,495 | B2 * | 2/2007 | Knecht et al. | 123/90.17 |
| 2002/0139334 | A1 * | 10/2002 | Kinugawa | 123/90.17 |
| 2003/0200944 | A1 | 10/2003 | Takahashi et al. | |
| 2006/0048731 | A1 | 3/2006 | Ikihara et al. | |
| 2007/0113811 | A1 * | 5/2007 | Grunow et al. | 123/90.17 |
| 2008/0289596 | A1 * | 11/2008 | Borraccia et al. | 123/90.17 |

FOREIGN PATENT DOCUMENTS

| | | | |
|---|---|---|---|
| DE | 199 21 667 | A1 | 11/2000 |
| EP | 0 518 472 | B1 | 12/1992 |
| EP | 1 128 026 | B1 | 8/2001 |
| JP | 11-182216 | A | 7/1999 |
| JP | 2006-170027 | A | 6/2006 |
| JP | 2007-182835 | A | 7/2007 |
| WO | WO 01/66915 | A2 | 9/2001 |

OTHER PUBLICATIONS

European Search report issued Apr. 9, 2010 by the European Patent Office in European Patent Application No. 08021402.6.

* cited by examiner

*Primary Examiner* — Thomas E. Denion
*Assistant Examiner* — Daniel A Bernstein
(74) *Attorney, Agent, or Firm* — Buchanan Ingersoll & Rooney PC

(57) ABSTRACT

A valve timing control apparatus includes a driving rotation member, a driven rotation member, an advance angle chamber displacing a rotation phase of the driven rotation member relative to the driving rotation member in an advance angle direction, a retard angle chamber displacing the relative rotation phase in a retard angle direction, a groove provided on at least one of an inner surface of the driving rotation member and an outer surface of the driven rotation member for supplying the hydraulic fluid to a sliding contact portion formed by the inner surface of the driving rotation member and the outer surface of the driven rotation member, an advance angle oil passage, a retard angle oil passage, and a groove oil passage for supplying the hydraulic fluid to the groove.

9 Claims, 5 Drawing Sheets

VALVE TIMING CONTROL APPARATUS

CROSS REFERENCE TO RELATED APPLICATIONS

This application is based on and claims priority under 35 U.S.C §119 with respect to Japanese Patent Application 2007-328858, filed on Dec. 20, 2007, the entire content of which is incorporated herein by reference.

FIELD OF THE INVENTION

This invention relates to a valve timing control apparatus.

BACKGROUND

A valve timing control apparatus is used for an internal combustion engine such as a vehicle engine to adjust opening and closing timing of a valve for achieving a suitable operating state of the internal combustion engine. The valve timing is controlled by displacing a relative rotation phase between a driving rotation member, which is synchronously rotated with the crankshaft, and a driven rotation member which is synchronously rotated with the camshaft.

An advance angle chamber and a retard angle chamber are formed between the driving rotation member and the driven rotation member. When the hydraulic fluid is supplied to the advance angle chamber, the rotation phase of the driven rotation member relative to the driving rotation member is displaced in an advance angle direction. When the hydraulic fluid is supplied to the retard angle chamber, the rotation phase is displaced in a retard angle direction. A partition such as a vane, provided at the driven rotation member, separates the advance angle chamber from the retard angle chamber.

In the valve timing control apparatus disclosed in JP H11-182216A, a groove is provided between an outer surface of the partition and an inner surface of the driving rotation member. A sliding contact portion between the outer surface of the partition and the inner surface of the driving rotation member is sealed due to the presence of the hydraulic fluid in the groove. Consequently, leaking of the hydraulic fluid, caused by a pressure difference between the advance angle chamber and the retard angle chamber, is prevented.

In the valve closing and opening timing apparatus disclosed in JP H11-182216A, when the oil pressure of the hydraulic fluid is high in one of fluid pressure chambers, i.e. the advance angle chamber or the retard angle chamber, the pressure of the hydraulic fluid, entering the sliding contact portion, becomes higher, compared to that of a normal case. When the hydraulic fluid enters the sliding contact portion, if the hydraulic fluid enters from the fluid pressure chamber to the groove filled with the hydraulic fluid, the hydraulic fluid overflows from the groove. As a result, the hydraulic fluid may leak to the other fluid pressure chamber, or the hydraulic fluid may leak to an exterior of the valve timing control apparatus through a communication hole into which a camshaft is inserted.

In the case, the oil pressure is not maintained at a proper level in the advance angle chamber or the retard angle chamber, and the performance deteriorates. For example, the response speed of the valve timing control apparatus slows down.

A need exists for a valve timing control apparatus which is not susceptible to the drawback mentioned above.

SUMMARY OF THE INVENTION

According to an aspect of the present invention, a valve timing control apparatus includes a driving rotation member rotating around an axis of a camshaft opening or closing a valve of an internal combustion engine in synchronization with a crankshaft of the internal combustion engine, a driven rotation member relatively rotating with the driving rotation member inside the driving rotation member, the driven rotation member integrally rotating with the camshaft, an advance angle chamber provided between the driving rotation member and the driven rotation member and displacing a rotation phase of the driven rotation member relative to the driving rotation member in an advance angle direction when a hydraulic fluid is supplied thereto, a retard angle chamber provided between the driving rotation member and the driven rotation member and displacing the rotation phase of the driven rotation member relative to the driving rotation member in a retard angle direction when the hydraulic fluid is supplied thereto, a groove provided on at least one of an inner surface of the driving rotation member and an outer surface of the driven rotation member for supplying the hydraulic fluid to a sliding contact portion formed by the inner surface of the driving rotation member and the outer surface of the driven rotation member, an advance angle oil passage for supplying the hydraulic fluid to the advance angle chamber, a retard angle oil passage for supplying the hydraulic fluid to the retard angle chamber, and a groove oil passage for supplying the hydraulic fluid to the groove.

BRIEF DESCRIPTION OF THE DRAWINGS

The foregoing and additional features and characteristics of the present invention will become more apparent from the following detailed description considered with reference to the accompanying drawings, wherein.

DETAILED DESCRIPTION

Hereinafter, an embodiment will be described with reference to drawings.

Figure 1:
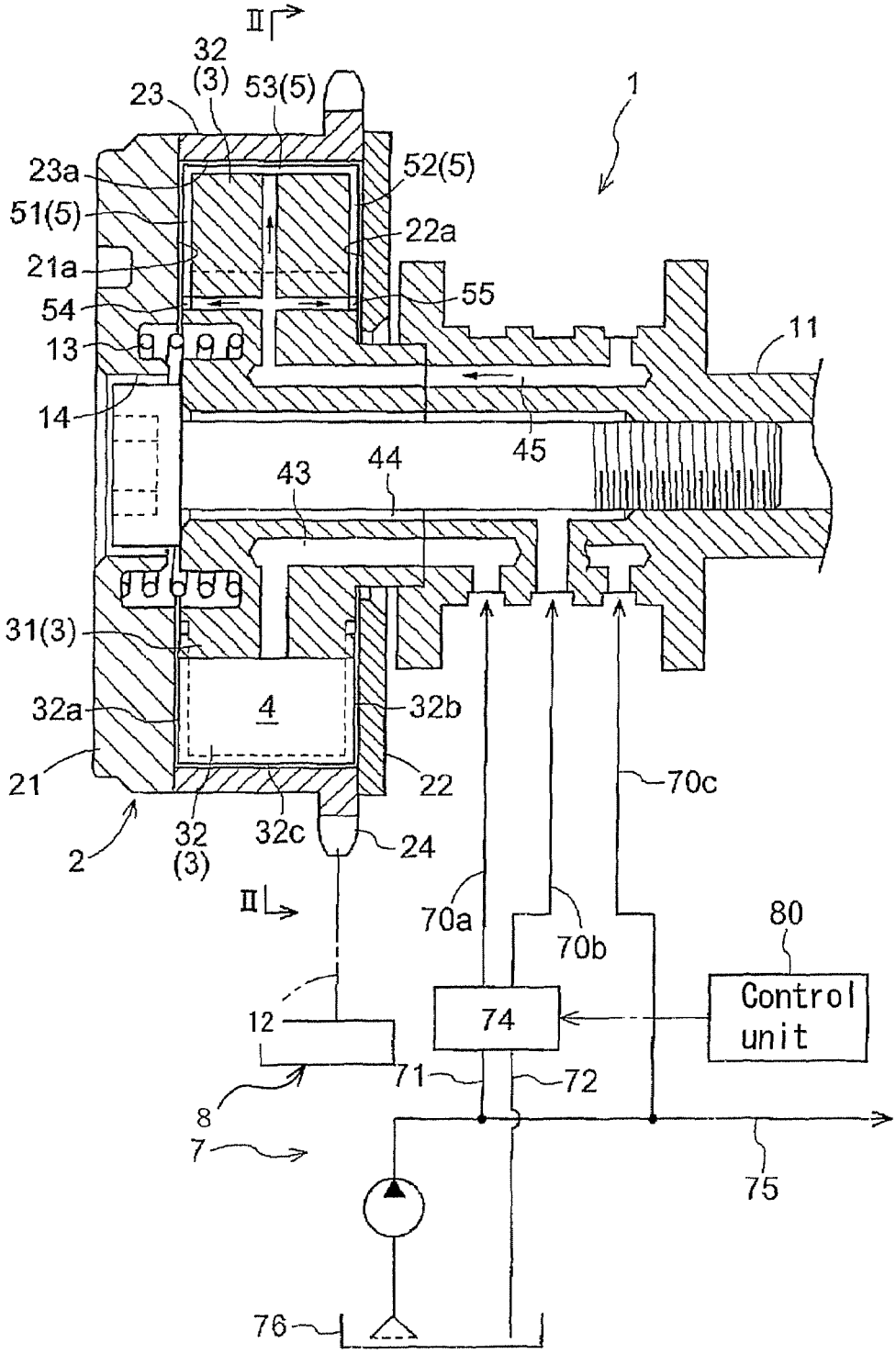
FIG. 1 is a schematic sectional view of a valve timing control apparatus according to a first embodiment of the invention.
Figure 2:
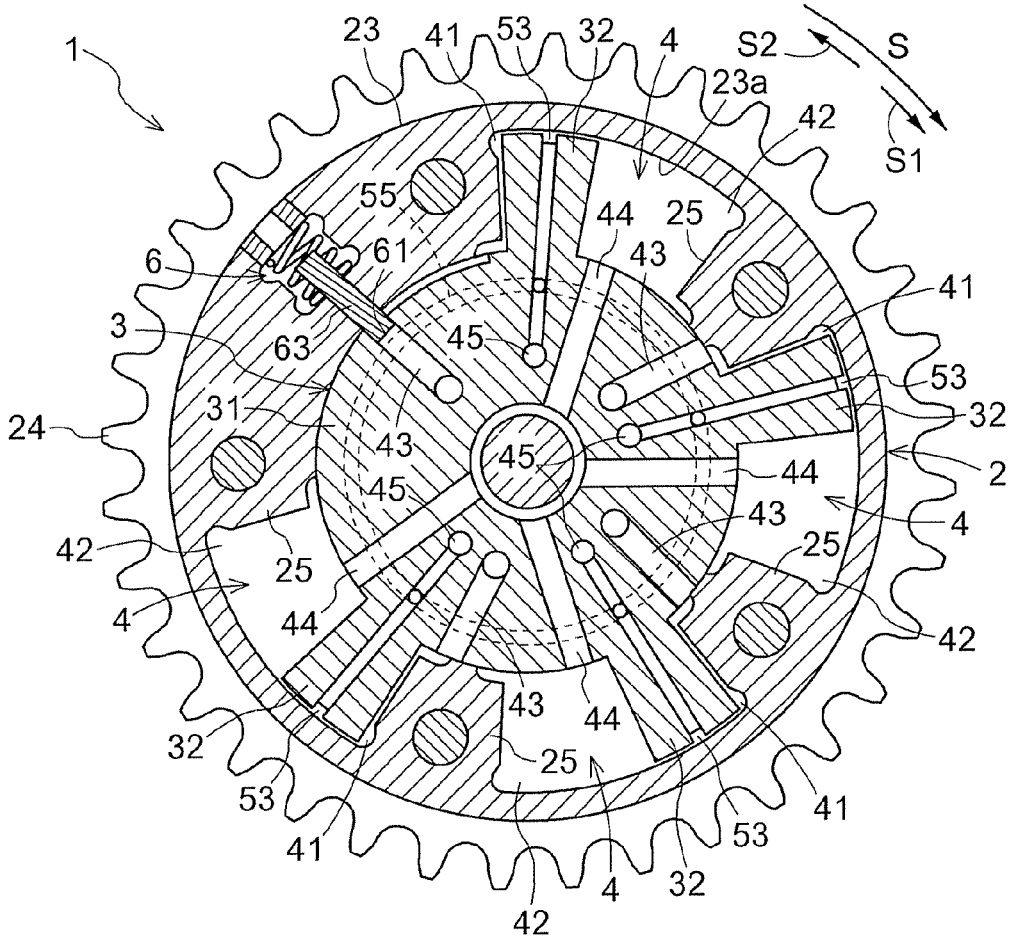
FIG. 2 is a schematic sectional view taken along a line II-II of FIG. 1.
Figure 3:
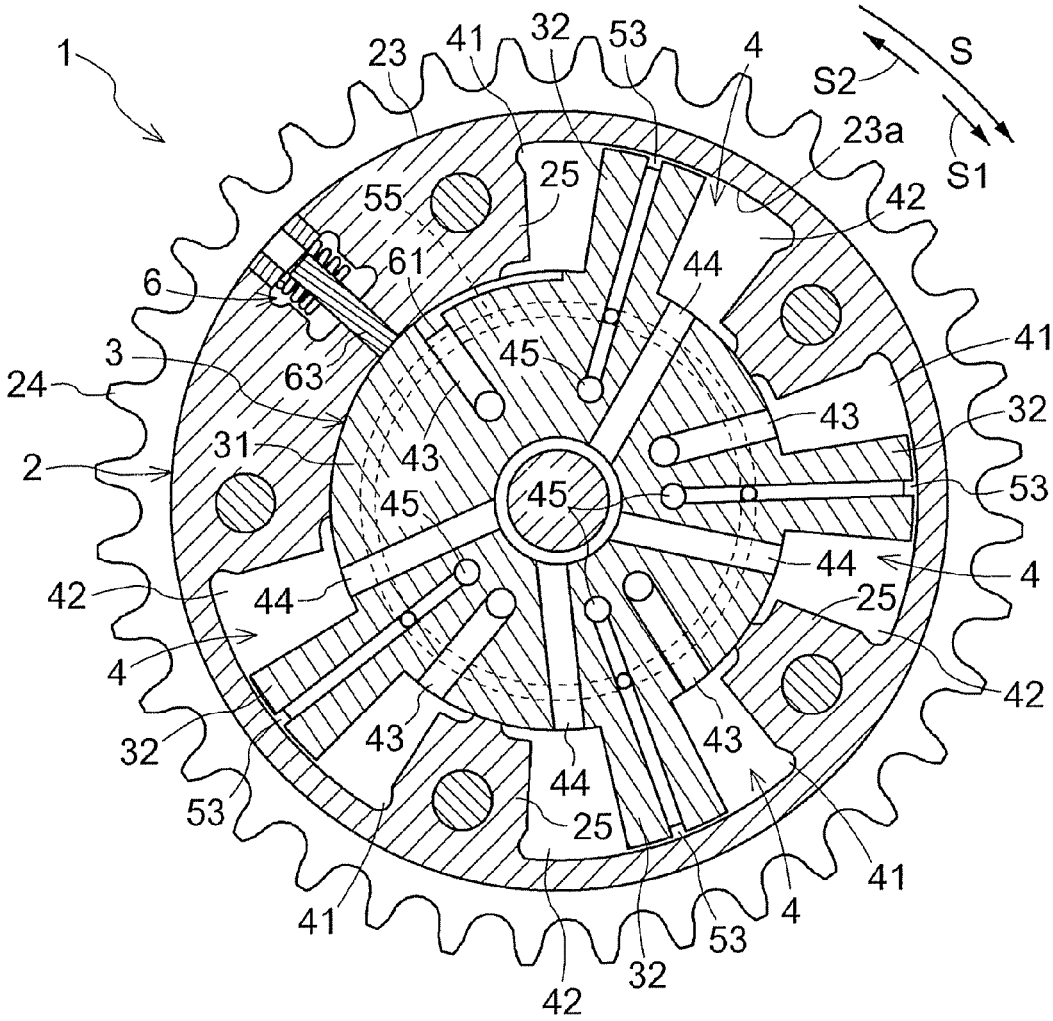
FIG. 3 is a schematic sectional view taken along a line II-II of FIG. 1.

FIGS. 1 to 4 are schematic views of a valve timing control apparatus 1 according to the embodiment. FIGS. 2 and 3 are sectional views taken along a line II-II of FIG. 1.

The valve timing control apparatus 1 is mounted on a vehicle including only an engine, serving as an internal combustion engine, as a driving means or on a hybrid vehicle including an engine and an electric motor as driving means. The valve timing control apparatus 1 includes an external rotor 2 serving as a driving rotation member and an internal rotor 3 serving as a driven rotation member. The external rotor 2 rotates around an axis of a camshaft 11, which opens and closes an engine valve, in synchronization with the crankshaft 8 of the engine. The internal rotor 3 integrally rotates with the camshaft 11 inside the external rotor 2 so as to change its rotation phase relative to the external rotor 2.

The valve timing control apparatus 1 according to the invention is provided with a groove 5 on at least one of an inner surface of the external rotor 2 and an outer surface of the internal rotor 3, which form a sliding contact portion, for supplying a hydraulic fluid to a part of the sliding contact portion arranged perpendicular to the camshaft 11. In addition, the valve timing control apparatus 1 is provided with a groove oil passage 45 for supplying the hydraulic fluid to the groove 5.

Typically, a hydraulic oil such as a lubricating oil is used as the hydraulic fluid. The hydraulic oil is reserved in a hydraulic fluid reservoir 76 provided at a lower portion of the engine and flows into an advance angle chamber 41, a retard angle chamber 42, and the groove 5 through oil passages, which will be described below. The viscosity of the hydraulic oil is usually high before driving the engine, i.e., before circulating the hydraulic oil in a predetermined path, and the resistance of the flow path is high. However, once the engine starts, the hydraulic oil circulates in the predetermined path, and the viscosity of the hydraulic oil becomes low. At the time, the resistance of the flow path, caused when the hydraulic oil flows in the path, also becomes low.

The external rotor 2 is constituted of a front plate 21, a rear plate 22, and a sprocket member 23. The front plate 21 is mounted on a side opposite to a side that the camshaft 11 is connected, and the rear plate 22 is mounted on the side that the camshaft 11 is connected. The sprocket member 23 is fixedly supported between the front plate 21 and the rear plate 22. A front wall 21*a*, a rear wall 22*a*, and a circumferential wall 23*a* are included inside the external rotor 2. The front wall 21*a* and the rear wall 22*a* are arranged perpendicular to the axis of the camshaft 11, and the circumferential wall 23*a* is arranged along a circumferential direction of the axis of the cam shaft 11. The internal rotor 3 is housed in a space defined by these walls 21*a*, 22*a*, and 23*a*.

A gear 24 is formed on an outer circumference of the sprocket member 23. A power transmitting member 12 such as a timing chain or a timing belt is installed between the sprocket member 23 and a gear mounted to the crankshaft 8 of the engine. Further, multiple projecting portions 25, each serving as a shoe projecting in a radial direction, are arranged along a rotation direction spaced away from each other.

The internal rotor 3 is integrally assembled to a distal portion of the camshaft 11 which serves as a rotation shaft of a cam controlling the opening and closing timing of an intake valve or an exhaust valve of the engine, and is fitted into the external rotor 2 so as to rotate relative to the external rotor 2 in a predetermined range.

The internal rotor 3 has a cylindrical base 31 and multiple partitions 32. The partitions 32 project from the cylindrical base 31 in the radial direction relative to the axis of the camshaft 11. Side surfaces 32*a* and 32*b* of the partition 32 slidably contact with the front wall 21*a* and the rear wall 22*a*, respectively, and an end surface 32*c* of the partition 32 slidably contacts with the circumferential wall 23*a*.

Fluid pressure chambers 4, each located between the adjacent projecting portions 25 of the external rotor 2, are formed by the external rotor 2 and the internal rotor 3. In the embodiment, the four fluid pressure chambers 4 are provided in the valve timing control apparatus 1. The partition 32 divides each fluid pressure chamber 4 into an advance angle chamber 41 and a retard angle chamber 42 in a relative rotation direction, i.e. directions indicated by arrows S1 and S2 in FIGS. 2 and 3.

When the crankshaft 8 of the engine rotates, rotation power is transmitted to the sprocket member 23 through the power transmitting member 12, and the external rotor 2 rotates in a rotation direction S shown in FIG. 2. In conjunction with the rotation of the external rotor 2, the internal rotor 3 is rotated in the rotation direction S through the hydraulic oil in the advance angle chamber 41 and the retard angle chamber 42 and the camshaft 11 rotates. Consequently, the cam provided at the camshaft 11 pushes down the intake valve or the exhaust valve of the engine to open the valve.

When the hydraulic oil is injected into the advance angle chamber 41 and the cubic measurement thereof increases, the rotation phase of the internal rotor 2 relative to the external rotor 3 is displaced in an advance angle direction (a direction indicated by the arrow S1 in FIGS. 2 and 3). When the hydraulic oil is injected into the retard angle chamber 42, the relative rotation phase is displaced in a retard angle direction (the direction indicated by the arrow S2 in FIGS. 2 and 3). A range that the internal rotor 3 rotates relative to the external rotor 2 corresponds to a movable range of the partition 32 inside each fluid pressure chamber 4, i.e., a range between the most advanced angle phase and the most retarded angle phase.

As shown in FIG. 1, a torsion spring 13 is provided between the internal rotor 3 and the front plate 21. Holding portions are respectively formed in the internal rotor 3 and the front plate 21, and end portions of the torsion spring 13 are respectively held by the holding portions. The torsion spring 13 provides torque to constantly bias the internal rotor 3 and the front plate 21 in a direction that the relative rotation phase is displaced in the advance angle direction S1.

The groove 5 is provided on at least one of the inner surface of the external rotor 2 and the outer surface of the internal rotor 3, which form the sliding contact portion. In other words, the groove 5 is provided on the sliding contact portion, and the configuration allows the groove 5 to be located between the advance angle chamber 41 and the retard angle chamber 42. The valve timing control apparatus 1 includes the groove oil passage 45 for supplying the hydraulic oil to the groove 5.

When the hydraulic oil is supplied from the groove oil passage 45 to the groove 5, an entry pressure of the hydraulic oil, which enters from the groove 5 to a side of the advance angle chamber 41 or the retard angle chamber 42, counters an entry pressure of the hydraulic oil, which enters from the advance angle chamber 41 or the retard angle chamber 42 to the groove 5. Thus, the flow of the hydraulic oil, flowing from the advance angle chamber 41 or the retard angle chamber 42 to the groove 5 through the sliding contact portion, is hampered, and the sliding contact portion is sealed between the advance angle chamber 41 and the retard angle chamber 42. Accordingly, the hydraulic oil is prevented from leaking to the other fluid pressure chamber or an exterior of the valve timing control apparatus 1.

Therefore, an oil pressure is easily maintained at a proper level in the advance angel chamber 41 or the retard angle chamber 42, and the response speed of the valve timing control apparatus 1 improves, resulting in performance enhancement.

In the embodiment, the groove 5 is formed on the outer surface of the internal rotor 3, i.e. the side surfaces of the partition 32 opposing the front wall 21*a* or the rear wall 22*a*.

Here, a front groove 51 is formed on the side surface 32*a* of the partition 32 opposing the front wall 21*a*, and a rear groove 52 is formed on the side surface 32*b* of the partition 32 opposing the rear wall 22*a*. The front groove 51 and the rear groove 52 are linearly arranged to form a line along the radial direction, respectively.

Although the partition 32 changes its phase in response to the rotation of the internal rotor 3, the side surfaces 32*a* and 32*b* of the partition 32 slidably contact with the external rotor 2 wherever the rotation phase of the partition 32 lies. Thus, in case that the groove 5 is formed on the side surfaces 32*a* and 32*b* of the partition 32, the groove 5 is constantly present on the sliding contact portion which is arranged perpendicular to the axis of the camshaft 11. Consequently, the sliding contact portion is sealed between the advance angle chamber 41 and the retard angle chamber 42.

Further, an end surface groove 53, which is in communication with the front and rear grooves 51 and 52 provided on the side surfaces 32*a* and 32*b* of the partition 32, is formed on the radial end surface 32*c* of the partition 32.

In case that the end surface groove 53 is formed on the radial end surface 32*c*, the groove 5 is constantly present on the sliding contact portion of the radial end surface 32*c* of the partition 32. Thus, the hydraulic oil, which is moved to the sliding contact portion by a centrifugal force, is prevented from moving between the advance angle chamber 41 and the retard angel chamber 42.

A communication is created among the end surface groove 53, the front groove 51 and the rear groove 52. Thus, the hydraulic oil is automatically supplied to all grooves 51, 52 and 53 by supplying the hydraulic oil to one of the grooves 51, 52 and 53. Further, the hydraulic oil is supplied to multiple grooves with a simple configuration due to the creation of the communication among the end surface groove 53, the front groove 51 and the rear groove 52. Furthermore, the hydraulic oil is supplied to the multiple grooves with a substantially identical pressure, thus enabling easy hydraulic oil pressure control in each groove 5.

Additionally, annular grooves 54 and 55 are formed on at least one of the inner surface of the external rotor 2 and the outer surface of the internal rotor 3, which form the sliding contact portion located between the external rotor 2 and the cylindrical base 31. The annular grooves 54 and 55 are coaxially arranged with the axis of the camshaft 11.

Namely, the front annular groove 54 is formed on a side opposing the front wall 21*a* and the rear annular groove 55 is formed on a side opposing the rear wall 22*a*.

The annular grooves 54 and 55 are formed so as to surround the axis of the camshaft 11. In other words, the annular grooves 54 and 55 are formed between the fluid pressure chambers 4 and a communication hole 14 into which the camshaft 11 is inserted. Thus, the flow of the hydraulic oil, flowing from each fluid pressure chamber 4 to the communication hole 14 through the sliding contact portion, is hampered and the hydraulic oil in each fluid pressure chamber 4 is assuredly prevented from leaking from the communication hole 14 to the exterior of the valve timing control apparatus 1.

Figure 4:
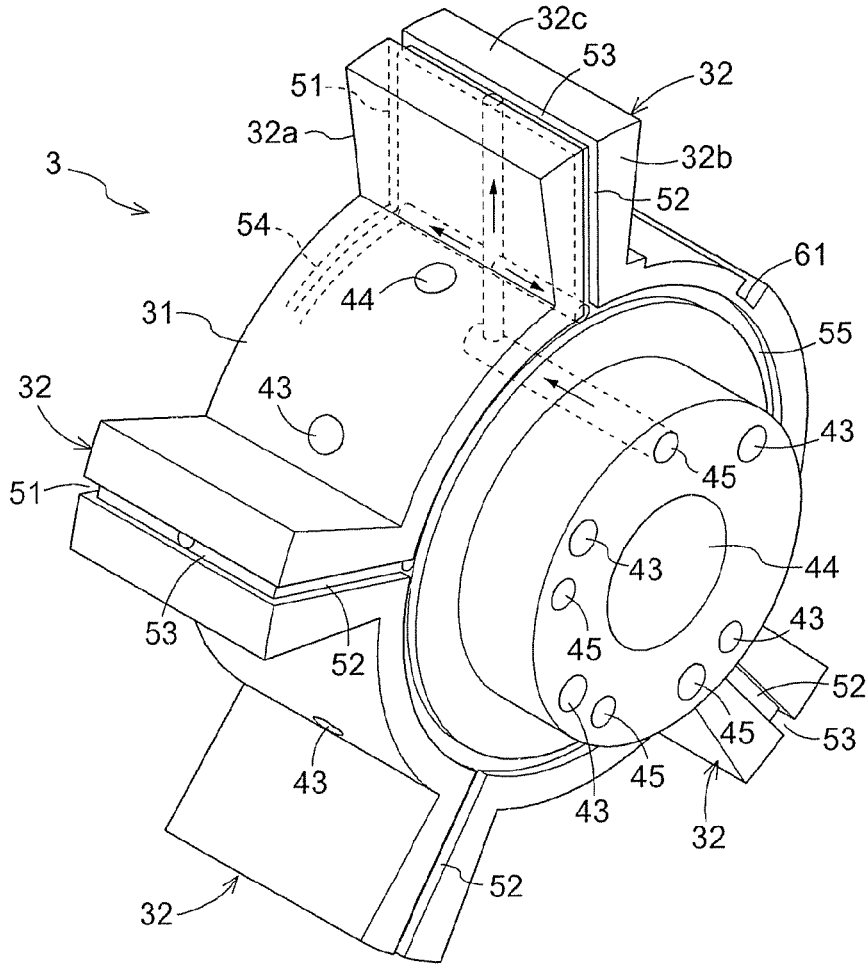
FIG. 4 is a schematic perspective view of an internal rotor.

The annular grooves 54 and 55 are formed so as to communicate with at least one of the front groove 51, the rear groove 52, and the end surface groove 53. In the embodiment, as shown in FIG. 4, the front annular groove 54 is in communication with the front groove 51, and the rear annular groove 55 is in communication with the rear groove 52. Thus, the hydraulic oil is supplied to the multiple grooves with a simple configuration. Further, for example, the oil pressure is controlled to be maintained at substantially the same level between the front groove 51 formed on the side surface 32*a* of the partition 32 and the front annular groove 54.

Other than the groove oil passage 45, the internal rotor 3 includes an advance angle oil passage 43 and a retard angle oil passage 44. The hydraulic oil is supplied to the advance angle chamber 41 through the advance angle oil passage 43, and is supplied to the regard angle chamber 42 through the retard angle oil passage 44.

The advance angle oil passage 43, the retard angle oil passage 44, and the groove oil passage 45 are connected with the oil pressure circuit 7 which will be described below. The hydraulic oil from the oil pressure circuit 7 is supplied or discharged to/from the advance angle chamber 41 and/or the retard angle chamber 42, thereby displacing the rotation phase of the internal rotor 3 relative to the external rotor 3 in the advance angle direction S1 or in the retard angle direction S2, or generating a biasing force holding the relative rotation phase at any phase.

As shown in FIGS. 2 and 3, the advance angle oil passage 43 of the advance angle chamber 41 which is located adjacent to a lock mechanism 6, out of the four advance angle chamber 41, is connected with a passage formed along the sliding contact surface of the internal rotor 3 which slidably contacts with the external rotor 3. The connection allows an engagement recessed portion 61 of the lock mechanism 6 and the advance angle chamber 41 to communicate with each other.

The lock mechanism 6 is configured so as to restrict the displacement of the relative rotation phase between the internal rotor 3 and the external rotor 2 at a predetermined locking phase by a lock portion 63.

The oil pressure circuit 7 includes a switching valve 74 which controls a supply/discharge state of the hydraulic oil between the advance and retard angle chambers 41 and 42 and the operation fluid reservoir 76. The operation of the switching valve 74 is controlled by a control unit 80.

An oil passage 70*a* and an oil passage 70*b* connect with the switching valve 74. The oil passages 70*a* and 70*b* respectively connect with the advance angle oil passage 43 and the retard angle oil passage 44. The oil pressure circuit 7 further includes a supply passage 71 and a discharge passage 72. The hydraulic oil is supplied from the operation fluid reservoir 76 to the switching valve 74 through the supply passage 71, and is discharged from the switching valve 74 to the operation fluid reservoir 76 through the discharge passage 72.

The oil passage 70*c* connecting with the groove oil passage 45 is directly connected with a main gallery 75, not through the switching valve 74. However, the configuration is not limited to this form, the oil passage 70*c* may be connected with the groove oil passage 45 through the switching valve 74. Further, a switching valve may be provided at the oil passage 70*c* for controlling the supply/discharge state of the hydraulic oil between the groove 5 and the operation fluid reservoir 76.

Other Embodiments (1) In the foregoing embodiment, the front and rear grooves 51 and 52 of the groove 5 are formed on the outer surface of the internal rotor 3, i.e. the side surfaces 32*a* and 32*b* of the partition 32 respectively opposing the front wall 21*a* and the rear wall 22*a*. However, the configuration is not limited to this form, and a configuration, in which only one of the front and rear grooves 51 and 52 is formed, may be employed. In this case, the configuration is simplified, leading to ease of manufacturing of the internal rotor 3.

Further, the groove 5 may be formed on the inner surface of the external rotor 2, i.e. the front wall 21*a* or the rear wall 22*a* (not shown). In this case, the groove 5 should be formed in a position that slidably contacts with the side surfaces 32*a* and 32*b* of the partition 32 on a constant basis. For example, the position may be set at a range that the inner surface of the external rotor 2 opposing the side surface of the partition 32 at the most retarded angle phase and the inner surface of the external rotor 2 opposing the side surface of the partition 32 at the most retarded angle phase are overlapped. This configuration allows the groove 5 to be constantly present on the sliding contact portion, and thus the hydraulic oil is prevented from flowing from one chamber to the other chamber through the sliding contact portion between the advance angle chamber 41 and the retard angle chamber 42. Therefore, the hydraulic oil is assuredly prevented from leaking to the other chamber.

The groove 5 may be provided at both the outer surface of the internal rotor 3 and the inner surface of the external rotor 2.

A load is applied to the internal rotor 3 in an axial direction (toward the rear plate 22 side) by the torsion spring 13 provided between the internal rotor 3 and the front plate 21. At the time, the surface of the rear plate 22 contacts with the surface of the rear wall 22*a*, and the hydraulic oil flows more smoothly in the sliding contact portion between the front plate 21 and the front wall 21*a*. Thus, the groove 5 may be formed only at the sliding contact portion in which the front plate 21 slidably contacts with the front wall 21*a*.

As described above, in case that the groove 5 is formed at a limited portion of the sliding contact portion, the manufacturing of the valve timing control apparatus 1 is simplified.

Figure 5:
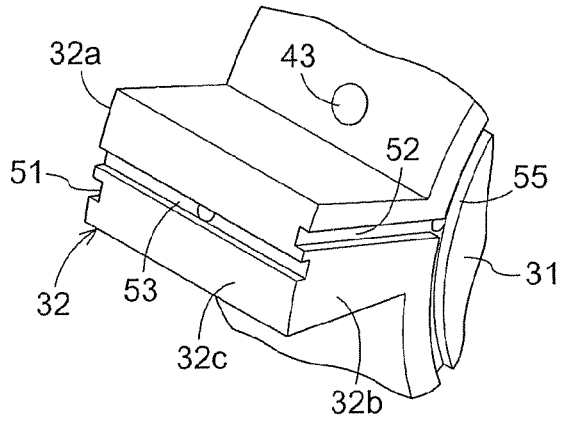
FIG. 5 is a schematic view showing a main section of a groove according to another embodiment.

(2) In the foregoing embodiment, the end surface groove 53 is in communication with the front groove 51 and the rear groove 52. However, the configuration is not limited to this form, and the end surface groove 53 may be formed so as to communicate with one of the front groove 51 and the rear groove 52. Further, as shown in FIG. 5, the end surface groove 53 may be formed so as not to communicate with both the front groove 51 and the rear groove 52.

In case that the end surface groove 53 is formed so as not to communicate with at least one of the front groove 51 and the rear groove 52, the hydraulic oil may be separately supplied to each groove from a groove oil passage separately provided and the supply pressure of the hydraulic oil may be controlled independently.

(3) In the foregoing embodiment, the annular groove includes the front annular groove 54 and the rear annular groove 55. However, a configuration, in which one of the front annular groove 54 and the rear annular groove 55 is formed, may be employed. In this case, the configuration is simplified, leading to the ease of the manufacturing of the internal rotor 3.

Further, the case that the annular groove is in communication with at least one of the front groove 51, the rear groove 52, and the end surface groove 53 is described above. However, the configuration is not limited to this form, and the annular groove may be formed so as not to communicate with the front groove 51, the rear groove 52, and the end surface groove 53. In this case, an oil passage is separately provided for supplying the hydraulic oil to the annular groove, and the oil pressure of the hydraulic oil flowing in the annular groove is controlled independently of the oil pressures flowing in the front groove 51, the rear groove 52, and the end surface groove 53.

Further, the annular groove 54 may be formed by multiple annular grooves having different diameters. In this case, multiple sealing positions of the hydraulic oil may be set in the radial direction. As a result, the hydraulic oil inside each fluid pressure chamber 4 may be assuredly prevented from leaking to the exterior of the valve timing control apparatus 1.

Figure 6:
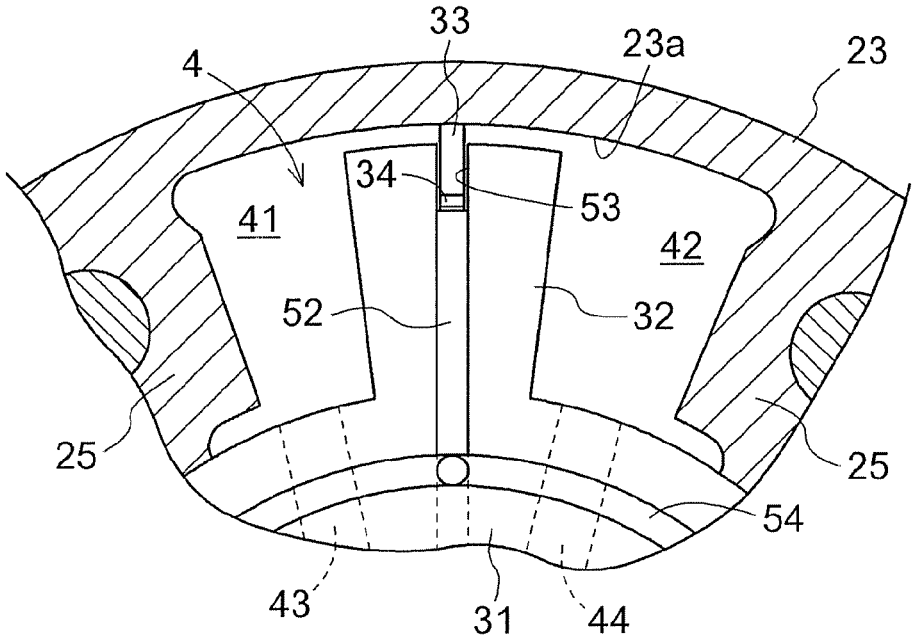
FIG. 6 is a schematic view showing a main section of a groove at which a sealing member is provided.
Figure 7:
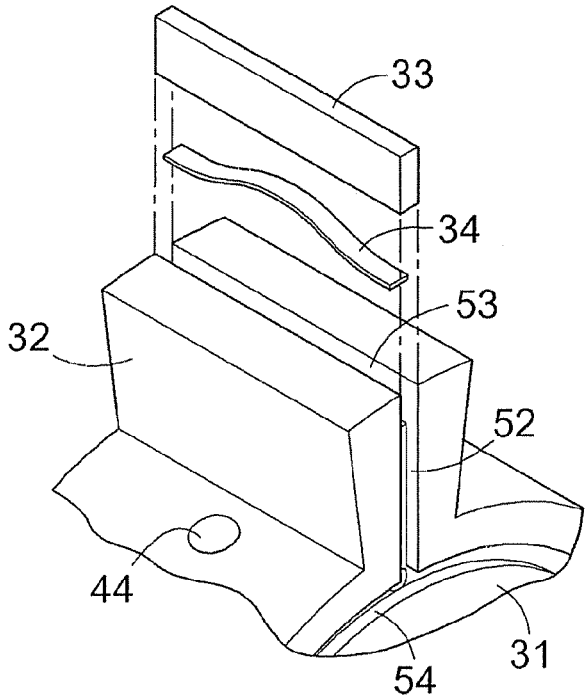
FIG. 7 is a schematic view showing the main section of the groove at which the sealing member is provided.

(4) As shown in FIGS. 6 and 7, a sealing member 33 may be disposed at the end surface 32*c* of each partition 32. In the case, a sealing groove is formed on the end surface 32*c*, and the sealing member 33 is inserted into the sealing groove. A sealing spring 34 is disposed between a bottom portion of the sealing groove and a bottom surface of the sealing member 33 for biasing the sealing member 33 in the radial direction (a direction of the circumferential wall 23*a*). FIGS. 6 and 7 show a case that the end surface groove 53 is also used as the sealing groove. Namely, the sealing member 33 and the sealing spring 34 are disposed in the end surface groove 53.

In the configuration, the sealing member 33 and the end surface groove 53 assuredly prevent the hydraulic oil from leaking from one fluid pressure chamber to the other fluid pressure chamber between the advance angle chamber 41 and the retard angle chamber 42 through the sliding contact portion of the end surface 32*c* and the circumferential wall 23*a*.

(5) In the embodiment described above, the front and rear grooves 51 and 52 are linearly arranged to form the line along the radial direction. However, the configuration is not limited to this form. For example, multiple grooves may be linearly arranged to form lines along the radial direction. Alternatively, the front and rear grooves 51 and 52 may be formed in waves. In these cases, compared to the groove linearly arranged to form a line, the leaking of the hydraulic oil is more assuredly prevented because the grooves are overlapped or the length of the front and rear grooves 51 and 52 becomes longer.

The invention may be utilized for a valve timing control apparatus including an external rotor rotating around an axis of a camshaft which opens and closes a valve of an internal combustion engine in synchronization with a crankshaft of the internal combustion engine, the external rotor having front and rear walls which are arranged perpendicular to the axis and a circumferential wall arranged along a circumferential direction of the axis, and further including an internal rotor integrally rotating with the camshaft inside the external rotor so as to change its rotation phase relative to the external rotor 2, an advance angle chamber formed between the external rotor and the internal rotor for displacing the rotation phase of the internal rotor relative to the external rotor in an advance angle direction when a hydraulic fluid is supplied thereto, and the retard angle chamber provided between the external rotor and the internal rotor for displacing the relative rotation phase between the external rotor and the internal rotor in a retard angle direction when the hydraulic fluid is supplied thereto.

In the sliding contact portion between the external rotor 2 and the internal rotor 3, the portion arranged perpendicular to the axis occupies a large area. Thus, a larger amount of the hydraulic oil leaks from the sliding contact portion arranged perpendicular to the axis. For the reason, the groove 5 is provided on at least the part of the sliding contact portion between the internal rotor 3 and the external rotor 2, which is arranged perpendicular to the axis, thereby preventing the hydraulic fluid from leaking from the part.

In the configuration, the groove 5 is provided at the sliding contact portion between the advance angle chamber 41 and the retard angle chamber 42, and the hydraulic fluid is supplied from the groove oil passage 45 provided separately from the advance angle oil passage 43 and the retard angle oil passage 44. At the time, the entry pressure of the hydraulic oil, which enters from the groove 5 to the side of the advance angle chamber 41 or the retard angle chamber 42, counters the entry pressure of the hydraulic oil, which enters from the advance angle chamber 41 or the retard angle chamber 42 to the groove 5. As a result, the flow of the hydraulic fluid, flowing from the advance angle chamber 41 or the retard angle chamber 42 to the groove 5 through the sliding contact portion, is hampered and the sliding contact portion is sealed between the advance angle chamber 41 and the retard angle chamber 42. Accordingly, the hydraulic fluid is prevented from leaking to the other fluid pressure chamber or the exterior of the valve timing control apparatus 1.

Therefore, the oil pressure is easily maintained at the proper level in the advance angel chamber 41 or the retard angle chamber 42, and the response speed of the valve timing control apparatus 1 improves, resulting in the performance enhancement.

According to an aspect of the embodiment, the internal rotor 3 has the cylindrical base 31 and the partitions 32 projecting from the cylindrical base 31 in the radial direction relative to the axis of the camshaft 11 for separating the advance angle chamber 41 from the retard angle chamber 42, and the groove 5 is formed on the radial end surface 32*c* of the partition 32 opposing the inner surface for the external rotor 2.

According to the configuration described above, the hydraulic fluid is supplied to all of the grooves 51, 52, and 53 by supplying the hydraulic fluid to one of the grooves 51 and 52 provided at the side surfaces 32*a* and 32*b* of the partition 32 or another groove 53. Creating the communication among the grooves 51, 52, and 53 allows the hydraulic fluid to be supplied to the multiple grooves with the simple configuration. Further, the hydraulic oil is supplied to the multiple grooves with substantially the same pressure, thus enabling the simplification of the oil pressure control in each groove.

According to another aspect of the embodiment, the internal rotor 3 has the cylindrical base 31 and the partitions 32 projecting from the cylindrical base 31 in the radial direction relative to the axis of the camshaft 11 for separating the advance angle chamber 41 from the retard angle chamber 42, and the groove 5 is formed on the side surfaces 32*a* and 32*b* of the partition 32 opposing the inner surface of the external rotor 2.

Although the partition 32 changes its phase in response to the rotation of the internal rotor 3, the side surfaces 32*a* and 32*b* of the partition 32 slidably contact with the external rotor 2 wherever the rotation phase of the partition 32 lies.

Thus, the groove 5 is constantly present in the sliding contact portion by being formed on the side surfaces 32*a* and 32*b* of the partition 32. Consequently, the sliding contact portion is sealed between the advance angle chamber 41 and the retard angle chamber 42. Therefore, the hydraulic oil is assuredly prevented from leaking to the other fluid pressure chamber through the sliding contact portion between the advance angle chamber 41 and the retard angle chamber 42.

According to another aspect of the embodiment, the annular groove 54 or 55 is formed on at least one of the inner surface of the external rotor 2 and the outer surface of the internal rotor 3, which form the sliding contact portion between the external rotor 2 and the cylindrical base 31, and the annular groove 54 or 55 is arranged coaxially with the axis of the camshaft 11.

For example, the hydraulic fluid may flow into a clearance between the inner surface of the external rotor 3 and the outer surface of the internal rotor 2 and then leaks to the exterior of the valve timing closing apparatus 1. The leakage leads to reduction of the hydraulic fluid inside the valve timing control apparatus 1.

According to the configuration, the annular grooves 54 and 55 are disposed so as to surround the axis of the camshaft 11. Namely, the annular grooves 54 and 55 are formed between the advance and retard angle chambers (fluid pressure chamber) 41 and 42 and the communication hole 14 into which the camshaft 11 is inserted. Thus, the flow of the hydraulic fluid, flowing from the fluid pressure chamber 41 or 42 to the communication hole 14 through the sliding contact portion, is hampered. Accordingly, the hydraulic fluid is assuredly prevented from leaking to the exterior of the valve timing control apparatus 1.

The present invention has been described in the foregoing specification. However, the invention, which is intended to be protected, is not to be construed as limited to the particular embodiment disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents that fall within the spirit and scope of the present invention as defined in the claims, be embraced thereby.

The invention claimed is:

1. A valve timing control apparatus comprising:

a driving rotation member rotating around an axis of a camshaft opening or closing a valve of an internal combustion engine in synchronization with a crankshaft of the internal combustion engine;

a driven rotation member relatively rotating with the driving rotation member inside the driving rotation member, the driven rotation member integrally rotating with the camshaft;

an advance angle chamber provided between the driving rotation member and the driven rotation member and displacing a rotation phase of the driven rotation member relative to the driving rotation member in an advance angle direction when a hydraulic fluid is supplied thereto;

a retard angle chamber provided between the driving rotation member and the driven rotation member and displacing the rotation phase of the driven rotation member relative to the driving rotation member in a retard angle direction when the hydraulic fluid is supplied thereto;

a groove provided on at least one of an inner surface of the driving rotation member and an outer surface of the driven rotation member for supplying the hydraulic fluid to a sliding contact portion formed by the inner surface of the driving rotation member and the outer surface of the driven rotation member;

an advance angle oil passage for supplying the hydraulic fluid to the advance angle chamber;

a retard angle oil passage for supplying the hydraulic fluid to the retard angle chamber; and a groove oil passage for supplying the hydraulic fluid to the groove.

2. A valve timing control apparatus according to claim 1, wherein the driven rotation member has a cylindrical base and a plurality of partitions projecting from the cylindrical base in a radial direction relative to the axis of the camshaft for separating the advance angle chamber from the retard angle chamber, and the groove is formed on a radial end surface of each partition opposing the inner surface of the driving rotation member.

3. A valve timing control apparatus according to claim 1, wherein the driven rotation member has a cylindrical base and a plurality of partitions projecting from the cylindrical base in a radial direction relative to the axis of the camshaft for separating the advance angle chamber from the retard angle chamber, and the groove is formed on a side surface of each partition opposing the inner surface of the driving rotation member.

4. A valve timing control apparatus according to claim 2, wherein an annular groove is formed on at least one of the inner surface of the driving rotation member and the outer surface of the driven rotation member, which form a part of the sliding contact portion between the driving rotation member and the cylindrical base, and the annular groove is arranged coaxially with the axis of the camshaft.

5. A valve timing control apparatus according to claim 1, wherein the driving rotation member includes a front wall arranged perpendicular to the axis of the camshaft, a rear wall arranged perpendicular to the axis of the camshaft, and a circumferential wall arranged along a circumferential direction of the axis of the camshaft, and the driven rotation member includes a cylindrical base and a plurality of partitions projecting from the cylindrical base in a radial direction relative to the axis of the camshaft for separating the advance angle chamber from the retard angle chamber, wherein the groove includes at least one of a front groove formed on a side surface of the partition opposing the front wall and a rear groove formed oil a side surface of the partition opposing the rear wall, and the groove further includes an end surface groove formed on a radial end surface of the partition opposing the circumferential wall, the end surface groove being in communication with at least the one of the front groove and the rear groove.

6. A valve timing control apparatus according to claim 2, wherein a sealing member projecting from the groove in a radial outward direction is provided at the groove formed on the radial end surface of the partition.

7. A valve timing control apparatus according to claim 6, wherein a spring biasing the sealing member in the radial outward direction is provided between the sealing member and the groove.

8. A valve timing control apparatus according to claim 3, wherein an annular groove is formed on at least one of the inner surface of the driving rotation member and the outer surface of the driven rotation member, which form a part of the sliding contact portion between the driving rotation member and the cylindrical base, and the annular groove is arranged coaxially with the axis of the camshaft.

9. A valve timing control apparatus according to claim 5, wherein a sealing member projecting from the groove in a radial outward direction is provided at the groove formed on the radial end surface of the partition.

* * * * *